United States Patent [19]

Onishi

[11] 4,213,431

[45] Jul. 22, 1980

[54] 2-CYCLE ENGINE OF AN ACTIVE THERMOATMOSPHERE COMBUSTION TYPE

[75] Inventor: Sigeru Onishi, Kanazawa, Japan

[73] Assignee: Toyota Jidosha Kogyo Kabushiki Kaisha, Toyota, Japan

[21] Appl. No.: 6,897

[22] Filed: Jan. 26, 1979

[30] Foreign Application Priority Data

Feb. 9, 1978 [JP] Japan ..... 53-12942

[51] Int. Cl.[2] ..... F02M 75/06

[52] U.S. Cl. ..... 123/73 R; 123/73 A; 123/73 PP; 123/73 SP; 123/568

[58] Field of Search ..... 123/73 A, 73 R, 73 PP, 123/73 SP, 119 A

[56] References Cited

U.S. PATENT DOCUMENTS

| | | | |
|---|---|---|---|
| 904,267 | 11/1908 | Korting et al. | 123/73 A |
| 1,001,404 | 8/1911 | Holloway | 123/73 A |
| 1,101,374 | 6/1914 | Woolery | 123/73 A |
| 2,058,526 | 10/1936 | Tanner | 123/73 A |
| 2,446,094 | 7/1948 | Mattice | 123/119 A |
| 2,851,021 | 9/1958 | Covone | 123/119 A |
| 3,195,524 | 7/1965 | Heidner | 123/73 A |
| 3,527,265 | 9/1970 | Jennings | 123/119 A |
| 3,581,719 | 6/1971 | Gau | 123/119 A |
| 3,785,151 | 1/1974 | Hull | 123/119 A |
| 3,807,376 | 4/1974 | Glockler et al. | 123/119 A |

*Primary Examiner*—Wendell E. Burns

*Attorney, Agent, or Firm*—Stevens, Davis, Miller & Mosher

[57] ABSTRACT

A 2-cycle engine having a transfer passage communicating the crank case with the combustion chamber. The transfer passage comprises a first passage and a second passage. The first passage has a long length and a small cross-sectional area for causing a fresh combustible mixture to flow at a high speed. The second passage has a short length and a large cross-sectional area for causing a fresh combustible mixture to flow at a low speed. An exhaust gas recirculation device is provided for recirculating the exhaust gas from the exhaust system into the intake system of the engine.

22 Claims, 8 Drawing Figures

2-CYCLE ENGINE OF AN ACTIVE THERMOATMOSPHERE COMBUSTION TYPE

DESCRIPTION OF THE INVENTION

The present invention relates to a 2-cycle engine of an active thermoatmosphere combustion type.

As a 2-cycle engine capable of considerably reducing the fuel consumption and the amount of harmful components in the exhaust gas, and also, capable of obtaining the quiet operation of the engine, the inventor has already proposed an active thermoatmosphere combustion type 2-cycle engine. In this 2-cycle engine, the cross-section of the transfer passage communicating the crank room with the combustion chamber is restricted at a position near the crank room when the engine is operating under a partial load and, as a result, a fresh combustible mixture is caused to flow into the combustion chamber at a low speed. In this engine, since the fresh combustible mixture flows into the combustion chamber at a low speed, as mentioned above, an active thermoatmosphere is created in the combustion chamber. Then, the active thermoatmosphere continues to be maintained during the compression stroke, and self-ignition of the fresh combustible mixture is caused at the end of the compression stroke.

In this engine, when the engine is operating under a partial load, the complete active thermoatmosphere combustion, which is not caused by the spark plug, is carried out and, as a result, the fuel consumption and the amount of harmful components in the exhaust gas are considerably reduced. However, when the engine is operating under a heavy load, since the fresh combustible mixture flows into the combustion chamber at a high speed, movement and turbulence of the residual burned gas in the combustion chamber is caused. As a result of this, it is difficult to cause complete active thermoatmosphere combustion. Nevertheless, in this case, since the vaporization of the liquid fuel contained in the fresh combustible mixture is sufficiently vaporized before the fresh combustible mixture flows into the combustion chamber, the fuel consumption is improved and, at the same time, the amount of harmful components in the exhaust gas is considerably reduced as compared with those in a conventional 2-cycle engine. However, although the amount of harmful components, for example NOx, in the exhaust gas is considerably reduced as compared with that in a conventional 2-cycle engine, the amount of harmful NOx components in the exhaust gas still increases as the level of load of the engine is increased as in a conventional 2-cycle engine.

An object of the present invention is to provide a 2-cycle engine capable of reducing the amount of harmful NOx components in the exhaust gas by recirculating exhaust gas into the intake system of an engine.

In the field of engines, as a method of reducing the amount of harmful NOx components in the exhaust gas, a method of recirculating the exhaust gas into the intake system of an engine is conventionally well known. However, in a conventional 2-cycle engine, if the exhaust gas is recirculated into the intake system, since the ignition becomes more difficult, it is difficult to recirculate the exhaust gas into the intake system. Nevertheless, in an active thermoatmosphere combustion, the production of radicals in the combustion chamber is promoted by recirculating the exhaust gas into the fresh combustible mixture. Consequently, in an active thermoatmosphere combustion 2-cycle engine, the exhaust gas recirculation has a function of ensuring a stable active thermoatmosphere combustion in addition to a function of reducing the amount of harmful NOx components in the exhaust gas. In addition, the active thermoatmosphere combustion has such an essential feature that, even if the exhaust gas recirculation ratio is set at 40 percent, a stable combustion can be obtained. Consequently, since a large amount of the exhaust gas can be recirculated into the intake system while maintaining stable combustion, it is possible to considerably reduce the amount of harmful NOx components in the exhaust gas.

According to the present invention, there is provided a 2-cycle engine comprising: an engine body having therein a cylinder bore and a crank room which has a bottom wall; a piston reciprocally movable in said cylinder bore, said piston and said cylinder bore defining a combustion chamber; an intake passage having mixture forming means therein for introducing a fresh combustible mixture into said crank room; and exhaust passage having an exhaust port opening into said combustion chamber for discharging exhaust gas into the atmosphere; transfer passage means communicating said crank room with an inlet port opening into said combustion chamber for leading the fresh combustible mixture into said combustion chamber from said crank room; restricting means arranged in said transfer passage means at a position near said combustion chamber for restricting the cross-section of said transfer passage means; and means for recirculating the exhaust gas into said intake passage from said exhaust passage.

The present invention may be more fully understood from the description of preferred embodiments of the invention set forth below, together with the accompanying drawings.

DESCRIPTION OF PREFERRED EMBODIMENTS

Figure 1:
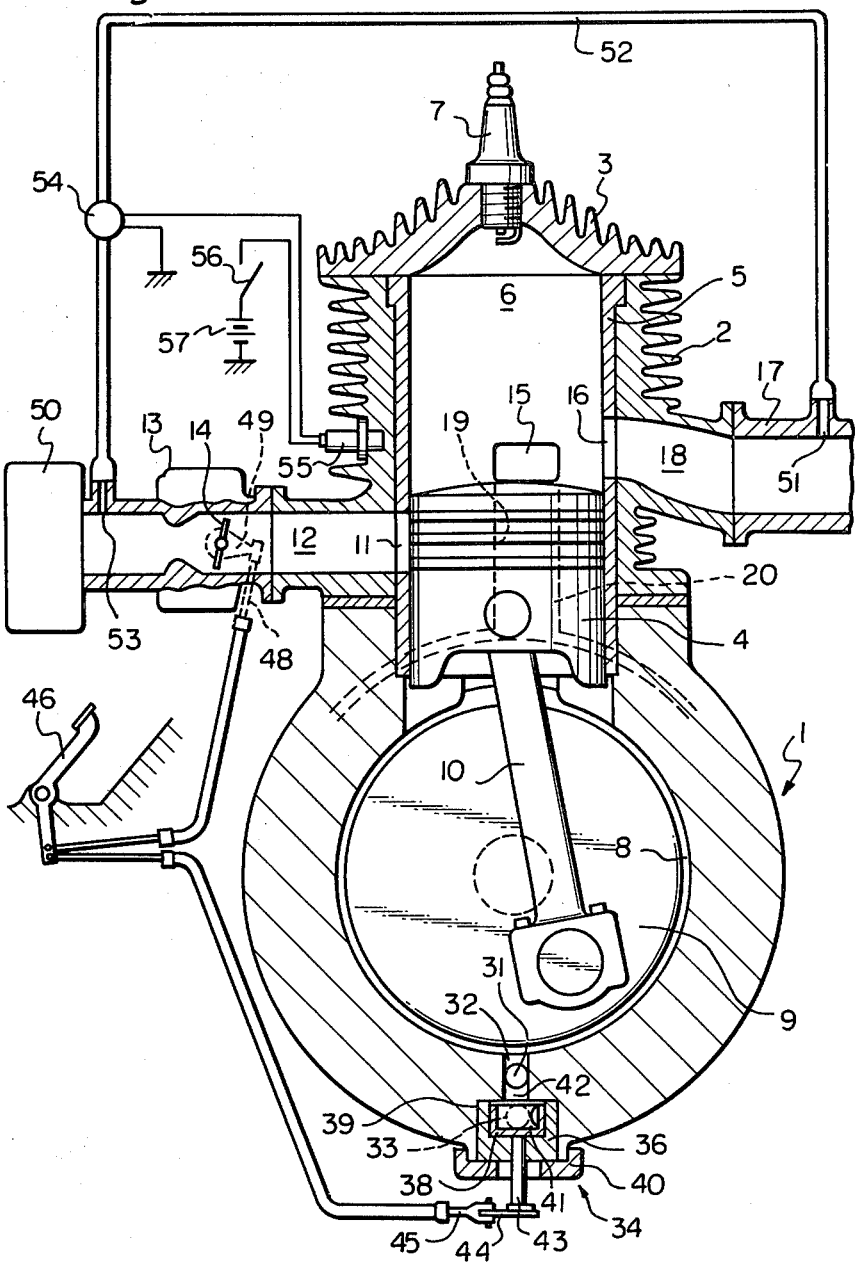
FIG. 1 is a cross-sectional side view of an embodiment of a 2-cycle engine according to the present invention.
Figure 2:
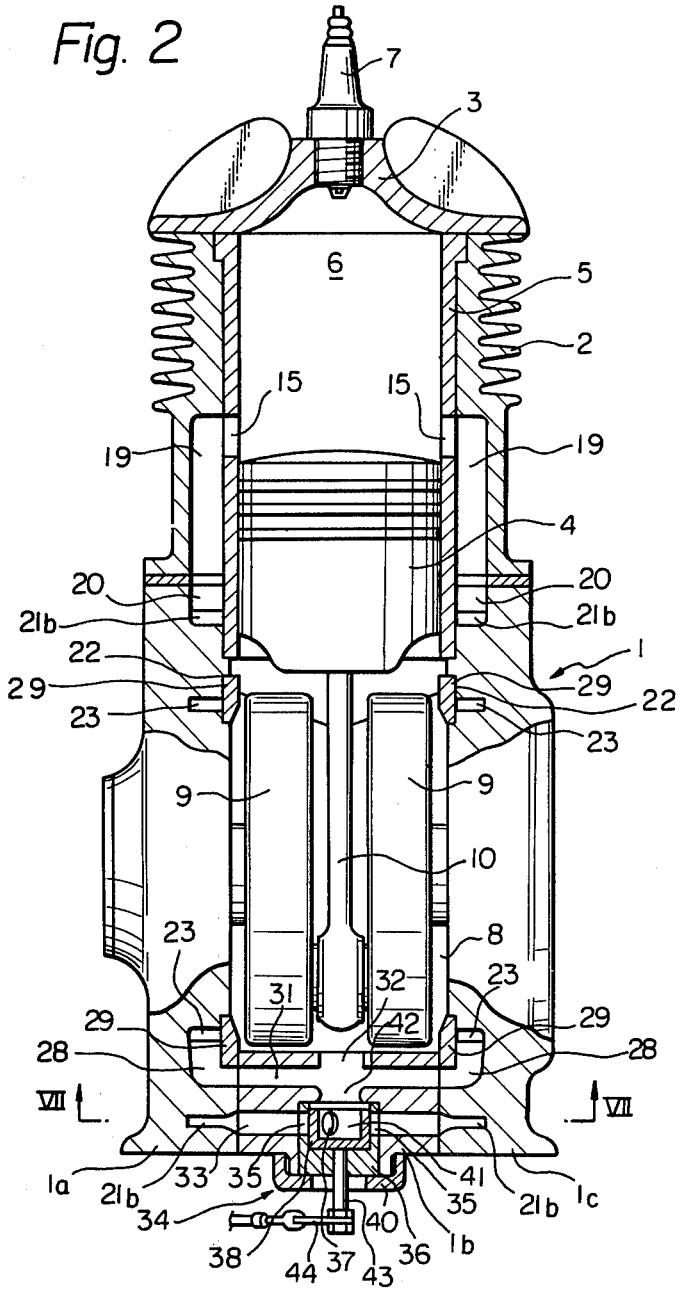
FIG. 2 is a cross-sectional side view of the engine shown in FIG. 1.

Referring to FIGS. 1 and 2, 1 designates a crank case, 2 a cylinder block fixed onto the crank case, 3 a cylinder head fixed onto the cylinder block 2, 4 a piston having an approximately flat top face and reciprocally moving in a cylinder liner 5 fitted into the cylinder block 2 and 6 a combustion chamber formed between the cylinder head 3 and the piston 4; 7 designates a spark plug arranged on the apex of the combustion chamber 6; 8 designates a crank room formed in the crank case 1 and 9 a balance weight; 10 designates a connecting rod, 11 an intake port formed in the cylinder liner 5; 12 designates an intake passage and 13 a carburetor; 14 designates a throttle valve of the carburetor 13, 15 a pair of inlet ports formed in the cylinder liner 5; 16 designates an exhaust port, formed in the cylinder liner 5; 17 designates an exhaust pipe, 18 an exhaust passage, and 50 an air cleaner. A recirculated exhaust gas (hereinafter referred to as EGR gas) port 51 opening into the exhaust passage 18 is formed in the exhaust pipe 17, and this EGR port 51 is connected via an EGR conduit 52 to an EGR gas feed port 53, which opens into the intake passage 12 at a position upstream of the carburetor 13. An electromagnetic valve 54 is arranged in the EGR conduit 52. The solenoid (not shown) of the electromagnetic valve 54 is connected to a power source 57 via a temperature reactive switch 55 fixed onto the cylinder block 2 and via an ignition switch 56. This temperature reactive switch 55 is under the ON condition when the temperature of the cylinder block 2 is below a predetermined level, while the temperature reactive switch 55 is turned to the OFF condition when the temperature of the cylinder block 2 is increased beyond the predetermined level. On the other hand, the electromagnetic valve 54 closes the EGR conduit 52 when the solenoid of the electromagnetic valve 54 is energized, while the electromagnetic valve 54 opens the EGR conduit 52 when the solenoid of the electromagnetic valve 54 is energized, while the electromagnetic valve 54 opens the EGR conduits 52 when the solenoid of the electromagnetic valve 54 is de-energized. Consequently, when the ignition switch 56 is turned to the ON condition and, in addition, the temperature of the cylinder block 2 is relatively low, that is, before completion of the warm-up of an engine, the recirculating operation of the exhaust gas remains stopped. On the other hand, when the temperature of the cylinder block 2 is increased beyond the above-mentioned predetermined level, the electromagnetic valve 54 opens and, thus, the exhaust gas is recirculated into the intake passage 12. At this time, the pressure of the exhaust gas in the exhaust passage 18 is increased in proportion to the increase in the amount of the air introduced into the intake passage 12. Consequently, since the pressure difference between the pressure in the exhaust passage 18 and the pressure in the intake passage 12 is increased in proportion to the increase in the amount of the introduced air, the amount of the EGR gas recirculated into the intake passage 12 is increased in proportion to the increase in the amount of the introduced air. The embodiment illustrated in FIGS. 1 and 2 involves a Schnürle type 2-cycle engine having an effective compression ratio of 6.5:1.

Figure 5:
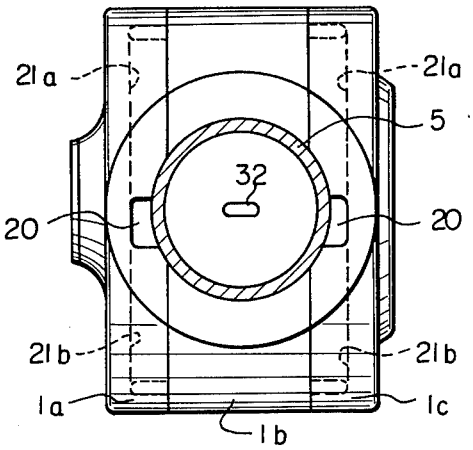
FIG. 5 is a plan view of a crank case.
Figure 6:
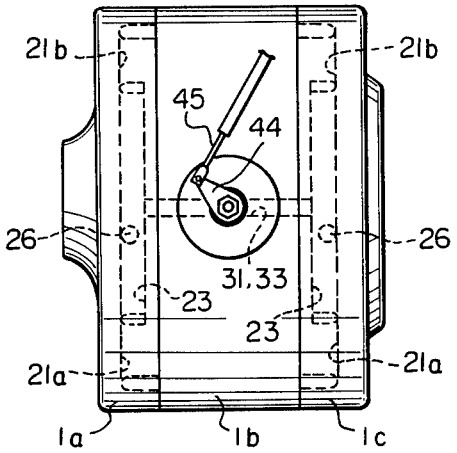
FIG. 6 is a bottom view of a crank case.

As illustrated in FIGS. 2, 5 and 6, the crank case 1 comprises three crank case parts 1*a*, 1*b* and 1*c*. A pair of transfer passages 19, each of which opens into the combustion chamber 6 at the inlet port 15 and vertically extends along the outer wall of the cylinder liner 5, is formed in the cylinder block 2, and the transfer passages 19 are connected to corresponding transfer passages 20, each of which is formed on the upper portion of the crank case 1 and aligned with the respective transfer passage 19. The transfer passage consisting of the transfer passages 20 and 21 is hereinafter referred to as a second transfer passage.

Figure 3:
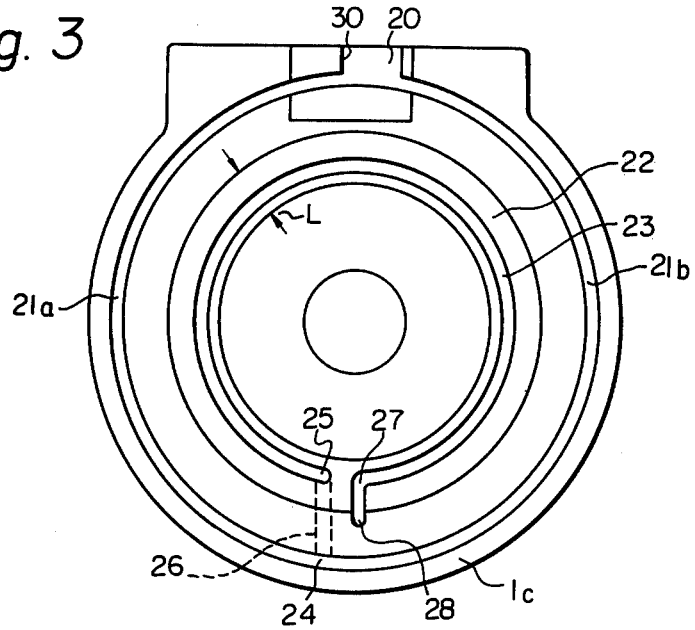
FIG. 3 is a front view of the crank case part 1*c;*
Figure 4:
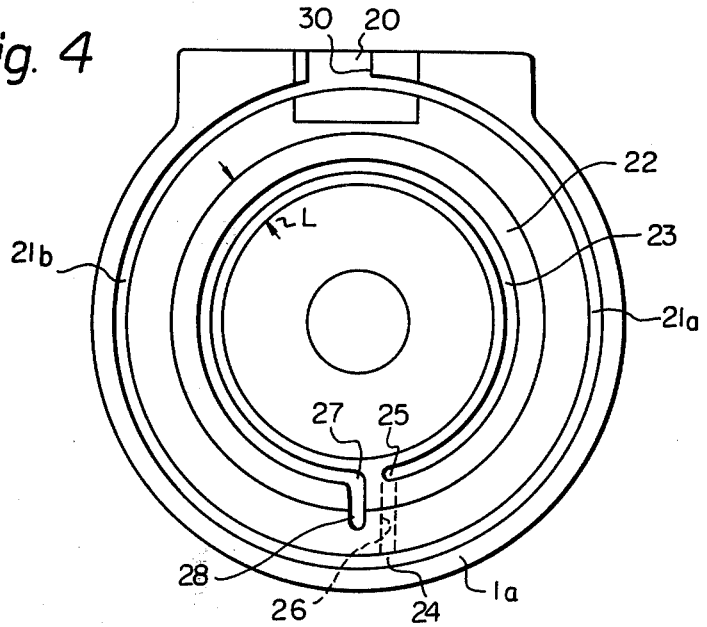
FIG. 4 is a front view of the crank case part 1*a;*

FIG. 3 illustrates the inner wall of the crank case part 1*c*, and FIG. 4 illustrates the inner wall of the crank case part 1*a*. Referring to FIGS. 3 and 4, a pair of grooves 21*a* and 21*b* is formed on the inner wall of the crank case parts 1*a*, 1*c* and arranged to extend along the circular periphery thereof. A shallow annular groove 22, having a fixed width L, is formed on the inner wall of the crank case parts 1*a*, 1*c* at a position located inward of the grooves 21*a* and 21*b*, and in addition, a groove 23 extending along the annular groove 22 is formed on the central portion of the bottom face of the annular groove 22. The grooves 21*a* and 21*b* are joined to each other at the lowest portion 24 thereof. One end 25 of the groove 23 is in communication with the lowest portion 24 of the grooves 21*a* and 21*b* via a hole 26 formed in the crank case parts 1*a*, 1*c* while the other end 27 of the groove 23 is connected to a short vertical groove 28 extending downwardly. As is illustrated in FIG. 2, annular plates 29 are fitted into the annular grooves 22 and urged onto the crank case parts 1*a*, 1*c* by the crank case part 1*b* when the crank case parts 1*a*, 1*b* and 1*c* are assembled to form the crank case 1, as illustrated in FIG. 2. Consequently, from FIGS. 2, 3 and 4, it will be understood that, when the crank case parts 1*a*, 1*b* and 1*c* are assembled to form the crank case 1, each of the grooves 21*a*, 21*b*, 23 and 28 forms a passage. In addition, from FIGS. 2 and 6, it will also be understood that the depth of the grooves 21*a*, 21*b* is deeper than that of the groove 23. As is illustrated in FIGS. 3 and 4, a groove 30 defining the transfer passage 20 and having a depth which is approximately equal to that of the grooves 21*a*, 21*b* is formed on the upper end portion of the inner wall of the crank case parts 1*a*, 1*c*, and each of the grooves 21*a* and 21*b* opens into the bottom of the groove 30. As is illustrated in FIGS. 1 and 2, a transverse hole 31 is formed in the lower end portion of the crank case part 1*b* and arranged to align with each of the vertical short grooves 28 which are formed on the inner walls of the respective crank case parts 1*a*, 1*c*. This transverse hole 31 is connected to the crank room 8 via a vertical hole 32 which is formed on the bottom wall of the crank room 8.

As will be understood from the above description, each of the transfer passages 20 is connected to the crank room 8 via the grooves 21*a*, 21*b*, the hole 26, the grooves 23, 28, the transverse hole 31 and the vertical hole 32. The passage consisting of the grooves 21*a*, 21*b*, the hole 26, the grooves 23, 28, the transverse hole 31 and the vertical hole 32 is hereinafter referred to as a first transfer passage. Consequently, it will be understood that the crank room 8 is connected to the combustion chamber 6 via the above-mentioned first transfer passage and the second transfer passage mentioned previously.

Referring to FIGS. 1, 2, 6 and 7, another transverse hole 33 is formed in the lower end portion of the crank case part 1*b* and arranged beneath the transverse hole 31 so as to interconnect the grooves 21*b* to each other, which grooves are formed on the inner walls of the crank case parts 1*a* and 1*c*, respectively. A valve device generally designated by reference numeral 34 is arranged in the other transverse hole 33. This valve device 34 comprises a sleeve 36 forming a pair of openings 35 thereon, and a hollow cylindrical rotary valve 38 forming a pair of openings 37 thereof. The sleeve 36 is fitted into a recess 39 formed on the bottom outer surface of the crank case part 1*b*, and the sleeve 36 is secured onto the crank case part 1*b* by means of a nut 40, so that the openings 35 of the sleeve 36 are aligned with the transverse hole 33. A valve chamber 41 formed within the rotary valve 38 is always in communication with the crank room 8 via a vertical hole 42 and the vertical hole 32 which are aligned with each other. A control rod 43 is fixed onto the bottom wall of the rotary valve 38, and a lever 44 is fixed onto the lower end of the control rod 43. The tip of the lever 44 is connected to an accelerator pedal 46 via a wire 45 and, in addition, the tip of a lever 47 fixed onto the throttle valve 14 is also connected to the accelerator pedal 46 via a wire 48.

Figure 7:
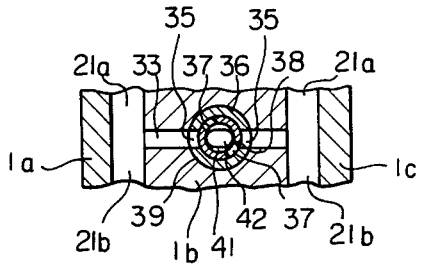
FIG. 7 is a cross-sectional view taken along the line VII—VII in FIG. 2.

FIG. 7 illustrates the case wherein the opening degree of the throttle valve 14 is small and, thus, the engine is operating under a light load. At this time, as is illustrated in FIG. 7, the openings 35 of the sleeve 36 are closed by the rotary valve 38 and, therefore, the crank room 8 is connected to the transfer passage 20 via the first transfer passage, that is, via the transverse hole 31, the grooves 28, 23, the hole 26 and the grooves 21*a*, 21*b*. When the accelerator pedal 46 is depressed, the throttle valve 14 and the rotary valve 38 are rotated, and then, the valve chamber 41 of the rotary valve 38 is connected to the transverse hole 33 via the openings 37, 35 when the opening degree of the throttle valve 14 becomes about 75 percent relative to the full open degree. Consequently, at this time, as is hereinafter described in detail, the fresh combustible mixture in the crank room 8 is fed into the transfer passage 20 via the vertical holes 32, 42, the openings 37, 35, the transverse hole 33 and the grooves 21*a*, 21*b*. That is, the transverse hole 33 forms a bypass passage used for feeding the fresh combustible mixture into the grooves 21*a*, 21*b* without passing through the groove 23 when the engine is operating under a heavy load.

In operation, when the engine is operating under a partial load, that is, when the openings 35 of the sleeve 36 is closed by the rotary valve 38, the fresh combustible mixture introduced into the crank room 8 from the intake port 11 together with the EGR gas is gradually compressed in accordance with the downward movement of the piston 4. At this time, although the fresh combustible mixture introduced into the crank room 8 contains a large amount of the liquid fuel, the vaporization of the liquid fuel is promoted by the EGR gas having a relatively high temperature. After this, the fresh combustible mixture containing the EGR gas therein is forced into the transverse hole 31 and then flows into the grooves 21*a*, 21*b* via the vertical groove 28, the groove 23 and the hole 26. As will be understood from FIGS. 1 and 6, since the groove 23 has an extremely small cross-sectional area, the fresh combustible mixture flows at a high speed in the groove 23 and then flows into the grooves 21*a*, 21*b*. As is mentioned above, the fresh combustible mixture is caused to flow at a high speed in the groove 23, the flow energy is added to the fresh combustible mixture and, as a result, the vaporization of the liquid fuel continues to be promoted during this time. Then, the fresh combustible mixture flows into the grooves 21*a* and 21*b*. As will be understood from FIGS. 1 and 6, since the cross-sectional area of the grooves 21*a*, 21*b* is larger than that of the passage 23 and, in addition, the fresh combustible mixture flowing out from the passage 23 is branched off into two streams, the flow velocity of the fresh combustible mixture flowing in the passages 21*a* and 21*b* is reduced, as compared with the case wherein the fresh combustible mixture flows in the passage 23. However, the flow velocity of the fresh combustible mixture flowing in the grooves 21*a* and 21*b* is relatively high and, thus, the liquid fuel which has not been vaporized in the groove 23 is sufficiently vaporized in the grooves 21*a* and 21*b*. After the vaporization of the fresh combustible mixture is sufficiently promoted, the fresh combustible mixture in the first transfer passage flows into the second transfer passage. At this time, since the streams of the fresh combustible mixture flowing out from the passages 21*a* and 21*b* come into violent contact with each other in the transfer passage 20 and lose kinetic energy, and in addition, the transfer passage 20 has a cross-sectional area which is considerably larger than those of the passages 21*a* and 21*b*, the fresh combustible mixture flowing into the transfer passage 20 from the passages 21*a* and 21*b* is abruptly decelerated. After this, the fresh combustible mixture moves upward at a low speed in the transfer passages 20 and 19, and then, flows into the combustion chamber 6 at a low speed when the piston 4 opens the inlet ports 15. Even if the pressure in the crank room 8 is considerably higher than that in the combustion chamber 6 when the piston 4 opens the inlet ports 15 to permit the inflow of the fresh combustible mixture into the combustion chamber 6, since the passage 23 functions as throttling means because it has a small cross-sectional area, the fresh combustible mixture cannot flow into the combustion chamber 6 at a high speed. As a result of this, the flow velocity of the fresh combustible mixture is low throughout the inflow operation of the fresh combustible mixture. Consequently, when the fresh combustible mixture flows into the combustion chamber 6, the movement of the residual burned gas in the combustion chamber 6 is extremely small and, as a result, the dissipation of the heat of the residual burned gas is prevented. Thus, the residual burned gas is maintained at a high temperature. In addition, at the beginning of the compression stroke under a partial load of the engine, a large amount of the residual burned gas is present in the combustion chamber 6. Since the amount of the residual burned gas in the combustion chamber 6 is large and, in addition, the residual burned gas has a high temperature, the fresh combustible mixture is heated until radicals are produced and, as a result, an active thermoatmosphere is created in the combustion chamber 6. An atmosphere wherein radicals are produced as mentioned above is hereinafter called an active thermoatomosphere. Since the movement of the gas in the combustion chamber 6 is extremely small during the compression stroke, the occurrence of turbulence and the loss of heat energy escaping into the inner wall of the combustion chamber 6 are restricted to the smallest possible extent. Consequently, the temperature of the gas in the combustion chamber 6 is further increased as the compressing operation progresses and, as a result, the amount of radicals produced in the combustion chamber 6 is further increased. When the radicals are produced, the combustion which is called a preflame reaction has been started. After this, when the temperature of the gas in the combustion chamber 6 becomes high at the end of the compression stroke, a hot flame generates to cause the self ignition which is not caused by the spark plug 7. Then, the gentle combustion is advanced while being controlled by the residual burned gas. When the piston 4 moves downwards and opens the exhaust port 16, the burned gas in the combustion chamber 6 is discharged into the exhaust passage 18.

When the engine is operating under a heavy load, that is, when the throttle valve 14 is greatly opened, the crank room 8 is connected to the grooves 21*a*, 21*b* via the openings 37, 35 and the transverse hole 33, that is, via the bypass passage as mentioned previously. At this time, the grooves 21*a*, 21*b* are in communication with the crank room 8 via the groove 23 and the transverse hole 31. However, since the cross-sectional area of the groove 23 is extremely small, the flow resistance of the passage 23 is large and, as a result, a large part of the fresh combustible mixture containing the EGR gas therein flows into the grooves 21*a*, 21*b* from the crank room 8 via the vertical holes 32, 42, the valve chamber 41, the openings 37, 35 and the transverse hole 33. As mentioned previously, since the cross-sectional area of the grooves 21*a*, 21*b* is larger than that of the groove 23 and, in addition, the fresh combustible mixture is branched off to two streams which flow in the grooves 21*a* and 21*b*, respectively, the fresh combustible mixture flowing in the passages 21*a*, 21*b* is subjected to the flow resistance which is smaller than the case wherein the fresh combustible mixture flows in the groove 23. As a result of this, a large amount of the fresh combustible mixture flows at a relatively high speed in the grooves 21*a* and 21*b*. At this time, the flow energy is added to the fresh combustible mixture flowing in the grooves 21*a*, 21*b* and, thus, the vaporization of the liquid fuel is promoted. After this, the fresh combustible mixture moves upwards at a relatively high speed in the transfer passages 20, 19 and then flows into the combustion chamber 6. At this time, since the fresh combustible mixture flows into the combustion chamber 6 at a relatively high speed, the turbulence and the movement of the residual burned gas in the combustion chamber 6 is caused. As a result of this, a complete active thermoatmosphere combustion cannot be carried out, and the fresh combustible mixture is ignited by the spark plug 7. However, even if the complete active thermoatmosphere combustion is not carried out, since the vaporization of the liquid fuel is considerably promoted and, in addition, the dissipation of the heat of the residual burned gas is reduced as compared with that in a conventional 2-cycle engine, specific fuel consumption is improved and, at the same time, the amount of harmful components in the exhaust gas is greatly reduced, because the EGR gas serves to additionally reduce the amount of harmful NOx components in the exhaust gas.

Figure 8:
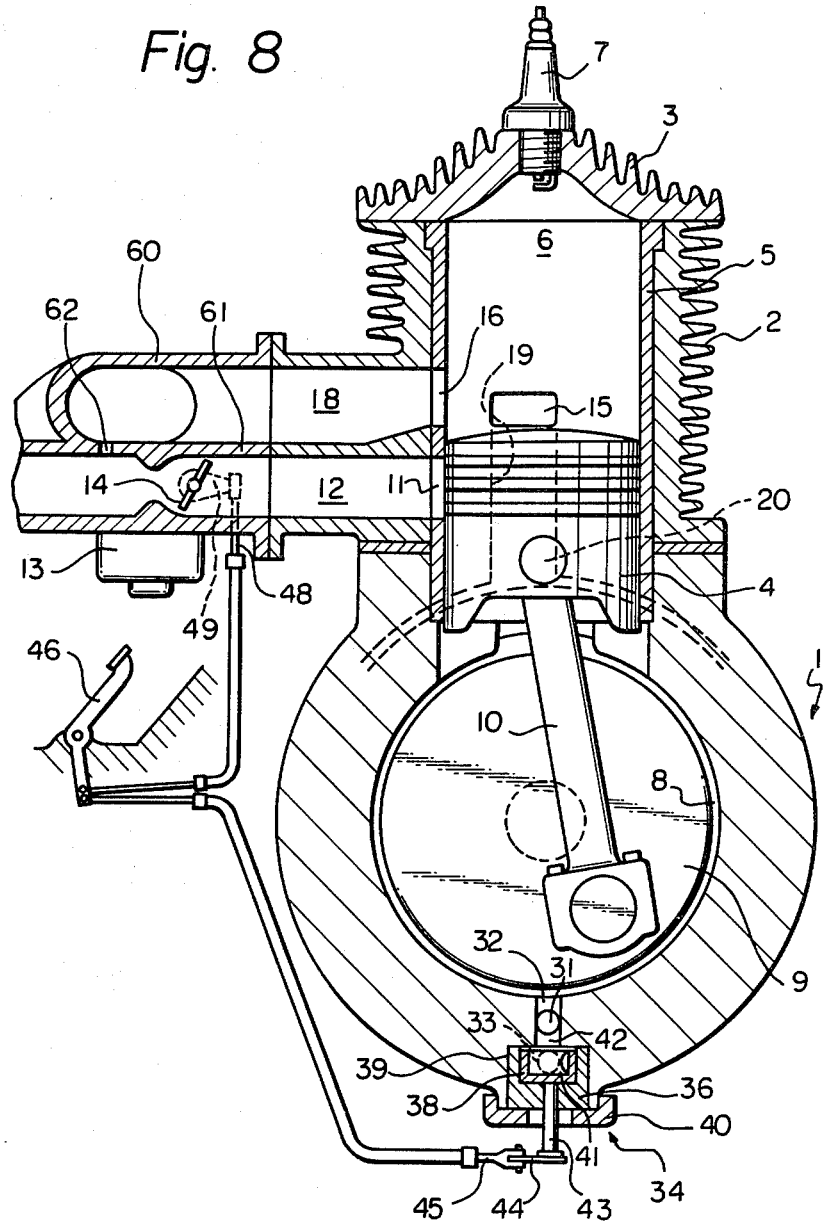
FIG. 8 is a cross-sectional side view of an alternative embodiment according to the present invention.

FIG. 8 illustrates an alternative embodiment. In this embodiment, as is illustrated in FIG. 8, the intake passage 12 and the exhaust passage 18 are formed in a manifold 60 formed in one piece, and the intake passage 12 and the exhaust passage 18 are separated by a common partition 61. An opening 62, communicating the intake passage 12 with the exhaust passages 18, is formed on the partition 61 so that the exhaust gas is recirculated into the intake passage 12 via the opening 62. In this embodiment, since the inner wall of the intake passage 12 is positively heated by the exhaust gas, the vaporization of the liquid fuel can be promoted in the intake passage 12. In addition, by merely forming the opening 62 on the partition 61, it is possible to recirculate the exhaust gas into the intake passage 12.

According to the present invention, since the recirculating operation of the exhaust gas can be carried out in a 2-cycle engine, the amount of harmful NOx components in the exhaust gas can be considerably reduced. In addition, there is an advantage that the production of radicals is further improved by recirculating the exhaust gas into the intake passage of an engine.

While the invention has been described by reference to specific embodiments chosen for purposes of illustration, it should be apparent that numerous modifications could be made thereto by those skilled in the art without departing from the spirit and scope of the invention.

What is claimed is:

1. A 2-cycle engine comprising:

an engine body having therein a cylinder bore and a crank room which has a bottom wall;

a piston reciprocally movable in said cylinder bore, said piston and said cylinder bore defining a combustion chamber;

an intake passage having mixture forming means therein for introducing a fresh combustible mixture into said crank room;

an exhaust passage having an exhaust port opening into said combustion chamber for discharging exhaust gas into the atmosphere;

transfer passage means communicating said crank room with an inlet port opening into said combustion chamber for leading the fresh combustible mixture into said combustion chamber from said crank room;

restricting means arranged in said transfer passage means at a position near said combustion chamber for restricting the cross-section of said transfer passage means; and means for recirculating the exhaust gas into said intake passage from said exhaust passage.

2. A 2-cycle engine as claimed in claim 1, wherein said recirculating means comprises a conduit communicating said intake passage with said exhaust passage, and a valve device arranged in said conduit for controlling the feeding operation of the exhaust gas.

3. A 2-cycle engine as claimed in claim 2, wherein said valve device comprises an electromagnetic valve and a temperature reactive switch fixed onto said engine body, said electromagnetic valve being actuated in response to the switching-over action of said temperature reactive switch for establishing the fluid connection between said intake passage and said exhaust passage when the temperature of said engine body is increased beyond a predetermined level.

4. A 2-cycle engine as claimed in claim 2, wherein said conduit has an exhaust gas feed port opening into said intake passage at a position upstream of said mixture forming means.

5. A 2-cycle engine as claimed in claim 1, wherein said intake passage and said exhaust passage are formed in a manifold housing formed in one piece, said manifold housing having therein a partition separating said intake passage and said exhaust passage.

6. A 2-cycle engine as claimed in claim 5, wherein said recirculating means comprises an opening communicating said intake passage with said exhaust passage and formed in said partition.

7. A 2-cycle engine as claimed in claim 1, wherein said transfer passage means comprises at least one first transfer passage connected to said crank room, and at least one second transfer passage communicating said first passage with said combustion chamber and having a cross-section which is larger than that of said first transfer passage, said restricting means being said first transfer passage.

8. A 2-cycle engine as claimed in claim 7, wherein the length of said first transfer passage is longer than that of said second transfer passage.

9. A 2-cycle engine as claimed in claim 7, wherein said second transfer passage has an approximately uniform cross-sectional area over the entire length thereof.

10. A 2-cycle engine as claimed in claim 7, wherein said second transfer passage comprises a first portion connected to said combustion chamber, and a second portion connected to said first transfer passage and having a cross-sectional area which is smaller than that of said first portion.

11. A 2-cycle engine as claimed in claim 10, wherein said second portion comprises a pair of branches opening into said second transfer passage so as to oppose each other, said branches being connected to the common first transfer passage.

12. A 2-cycle engine as claimed in claim 7, wherein said first transfer passage opens into said second transfer passage at a right angle relative to a longitudinal axis of said second transfer passage.

13. A 2-cycle engine as claimed in claim 7, wherein said first transfer passage has an inlet opening which is formed on the bottom wall of said crank room.

14. A 2-cycle engine as claimed in claim 7, wherein said engine further comprises bypass passage means communicating said second transfer passage with said crank room, normally closed valve means arranged in said bypass passage means and actuated in response to changes in the level of the load of the engine for opening said valve means when the load of the engine is increased beyond a predetermined level, and ignition means arranged in said combustion chamber.

15. A 2-cycle engine as claimed in claim 14, wherein said bypass passage means comprises a single bypass passage arranged beneath said crank room and said valve means comprises a single valve arranged in said bypass passage.

16. A 2-cycle engine as claimed in claim 15, wherein said bypass passage has an inlet opening which opens on the bottom wall of said crank room.

17. A 2-cycle engine as claimed in claim 14, wherein said bypass passage means has a cross-sectional area which is approximately equal to that of said second transfer passage.

18. A 2-cycle engine as claimed in claim 17, wherein said second transfer passage has an approximately uniform cross-section over the entire length thereof.

19. A 2-cycle engine as claimed in claim 17, wherein said second transfer passage comprises a first passage portion connected to said combustion chamber, and a second passage portion connected to said first transfer passage and having a cross-sectional area which is smaller than that of said first passage portion, said bypass passage means having a cross-sectional area which is approximately equal to that of said second passage portion.

20. A 2-cycle engine as claimed in claim 14, wherein said valve means comprises a valve device and a valve actuating device for opening said valve device when the load of the engine is increased beyond the predetermined level.

21. A 2-cycle engine as claimed in claim 20, wherein said valve device comprises a rotary valve.

22. A 2-cycle engine as claimed in claim 20, wherein said valve actuating device comprises an acceleration pedal.

* * * * *